United States Patent [19]

Kmetz

[11] 4,240,317

[45] Dec. 23, 1980

[54] ELECTRONIC MUSICAL INSTRUMENT

[75] Inventor: Gerald L. Kmetz, San Jose, Calif.

[73] Assignee: National Semiconductor Corporation, Santa Clara, Calif.

[21] Appl. No.: 831,876

[22] Filed: Sep. 9, 1977

[51] Int. Cl.[3] ..... G10H 1/00

[52] U.S. Cl. ..... 84/1.01; 84/1.03

[58] Field of Search ..... 84/1.01, 1.03, DIG. 22, 84/DIG. 12

[56] References Cited

U.S. PATENT DOCUMENTS

| | | | |
|---|---|---|---|
| 3,610,799 | 10/1971 | Watson | 84/1.26 |
| 3,842,702 | 10/1974 | Tsunoo | 84/1.01 |
| 3,921,491 | 11/1975 | Freeman | 84/1.03 |
| 3,929,051 | 12/1975 | Moore | 84/1.03 |
| 4,018,122 | 5/1977 | van der Kooij | 84/1.01 |
| 4,112,802 | 9/1978 | Robinson et al. | 84/DIG. 22 |
| 4,144,788 | 3/1979 | Bione et al. | 84/1.03 |
| 4,148,241 | 4/1979 | Morez et al. | 84/DIG. 22 |

*Primary Examiner*—J. V. Truhe
*Assistant Examiner*—Forester W. Isen
*Attorney, Agent, or Firm*—Brown & Martin

[57] ABSTRACT

An electronic organ having an improved note generator, an improved control logic circuit for assigning note generators to generate output frequency signals corresponding to selected notes in accordance with the availability of the note generators, and an improved combination of a bass note assignment circuit and bass note generator is disclosed.

3 Claims, 7 Drawing Figures

ELECTRONIC MUSICAL INSTRUMENT

BACKGROUND OF THE INVENTION

The present invention generally pertains to electronic musical instruments, such as, but not restricted to, electronic organs. The present invention is directed to improvements in certain components of an electronic musical instrument, particularly the note generators; the control logic circuits for assigning the note generators to generate output frequency signals corresponding to selected notes in accordance with the availability of the note generators; and the combination of a bass note assignment circuit and bass note generator.

An electronic musical instrument, such as an electronic organ, typically may include a keyboard having a plurality of keys for selecting predetermined musical notes in predetermined octaves; an encoder coupled to the keyboard for providing digital note address signals in response to manipulation of the keys on the keyboard; and a plurality of note generators that are responsive to the digital note address signals for respectively providing a plurality of output frequency signals corresponding to the selected musical notes in the selected octaves. In some prior art electronic musical instruments, the encoder may include a clock circuit for providing a pulsed scan clock signal; a keyswitch matrix connected to the keyboard, wherein the matrix includes columns and rows of conductors and a plurality of keyswitches, and wherein each of the keyswitches is arrayed in the matrix for connecting the conductor of a given row to the conductor of a given column in response to manipulation of a given key in the keyboard; a counter circuit connected to the clock circuit for counting the pulses in the scan clock signal; a decoder connected to the rows of the keyswitch matrix and to the counter circuit for sequentially providing signal pulses on the rows of the keyswitch matrix; a multiplexer connected to the columns of the keyswitch matrix and to the first counter for scanning the columns of the keyswitch matrix at the rate of the scan clock signal and for providing a serial keyboard data signal including pulses provided from the keyboard matrix in response to manipulation of the keys, wherein each pulse in the serial keyboard data signal corresponds to a selected musical note in a selected octave; and a control logic circuit that is responsive to the serial keyboard data signal for enabling the note generators to respond to the digital scan address signals in accordance with the availability of the note generators.

The electronic musical instruments described in U.S. Pat. Nos. 3,610,799 to Watson; 3,842,702 to Tsundoo; 3,929,051 to Moore; and 3,986,423 to Rossum include typical prior art note generators and control logic circuits for assigning note generators. However, such components are complex. Accordingly, it is an object of the present invention to provide an improved electronic musical instrument wherein these components are less complex.

Electronic musical instruments typically include one set of note generators that are dedicated to generating output frequency signals corresponding to melody and harmony notes and a separate set of note generators that are dedicated to generating chord notes.

Typically, there also is included a bass note generator which generates an output frequency signal corresponding to a predetermined bass note. The bass note has a predetermined relationship to one of the chord notes and typically is selected to be one octave lower than the root note when the instrument is being operated in an automatic chord mode, or to be one octave lower than the low chord note when the instrument is being operated in a manual chord mode. When the instrument is also being operated in an rhythm mode a second bass note is also selected. In the automatic chord mode, the second bass note is selected to be one octave lower than the fifth note of the chord, and in the manual chord mode, the bass note is selected to be one octave lower than the high note of the chord.

In such a prior art system, the bass note generators have a dedicated relationship to the chord note generators related to the position of the chord note in the chord, and ROM's (read only memories) are included to provide bass note assignment signals to the base note generators that are dedicated to provide an output frequency signal corresponding to the bass note having the desired relationship to the notes in the selected chord. In addition to including a complex switching circuit, this prior art system for generating bass notes, also provides a discontinuity in the bass note waveform when a switch is made between chords having some notes in common, and the same bass note is sounded in both chords. It is an object of the present invention to provide a less complex system of bass note assignment and generation.

SUMMARY OF THE INVENTION

According to one aspect of the present invention, an electronic musical instrument includes an encoder which is coupled to a keyboard for providing digital note address signals in response to manipulation of the keys on the keyboard, wherein the least significant bits of each note address signal indicate a predetermined musical note and the most significant bits of each note address signal indicate a predetermined octave; and the note generator includes a control ROM that is responsive to the least significant bits of the note address signal for providing a note control signal; a programmable divider that is responsive to the note control signal for dividing a high frequency clock signal to provide a signal corresponding to the predetermined musical note; a plurality of frequency dividers connected in series to the output of the programmable divider for providing from their respective outputs a plurality of signals corresponding to the selected musical note in successively lower octaves; and an octave multiplexer that is responsive to the most significant bits of the note address signal for selecting one of the plurality of signals from the programmable divider and the plurality of series connected frequency dividers to provide an output frequency signal corresponding to the selected musical note in the selected octave.

According to another aspect of the present invention, an electronic musical instrument includes a plurality of note generators; a plurality of memories equal in number to the plurality of note generators, with the memories being connected to a counter circuit for receiving a digital scan address signal for indicating individual keys on the keyboard; and being connected to the note generators for providing stored digital scan address signals to the note generators as the note address signals; and a control logic circuit that is responsive to a serial keyboard data signal for enabling the digital scan address signals to be stored into individual memories in accordance with the availability of the note generators;

wherein the control logic circuit includes a plurality of first logic gates respectively connected to the memories, wherein each first logic gate is enabled by a said pulse in said keyboard data signal for enabling the connected memory to store said scan address signal; a plurality of busy signal generators respectively coupled to the memories wherein each busy signal generator is responsive to the pulse in the serial keyboard data signal that enabled the coupled memory to store the scan address signal for generating a busy signal for so long as the key that was manipulated to provide that pulse continues to be manipulated, and wherein the first logic gate connected to the coupled memory is responsive to such busy signal for inhibiting the coupled memory from storing a scan address signal in response to a subsequent pulse in the serial keyboard data signal; a plurality of comparators respectively connected to the memories, wherein each comparator is for comparing the stored contents of the connected memory with the scan address signal and for providing a note taken signal when the scan address signal equals the stored contents of the connected memory; a second logic gate connected to the comparators for providing a signal to the first logic gates for inhibiting the first logic gates from enabling storage of the scan address signal in the respective connected memories whenever a note taken signal is provided from any one of the comparators; a shift register having a plurality of stages, with the outputs of the stages being respectively connected to the first logic gates for sequentially providing an enabling signal from only one of the output stages to the connected first logic gate to enable the scan address signal to be stored in only one connected memory in response to a single pulse in the serial data keyboard signal; and a third logic gate responsive to a busy signal generated from the busy signal generator that is connected to the memory that was enabled for storing the said scan address signal in response to the enabling signal from the one output stage that provided an enabling signal, for shifting the shift register to provide the enabling signal from a different stage.

According to still another aspect of the present invention, an electronic musical instrument includes a keyboard having a plurality of chord note keys for selecting predetermined musical chord notes in predetermined octaves; an encoder coupled to the keyboard for providing digital chord note address signals in response to manipulation of the chord note keys on the keyboard; and a plurality of chord note generators that are responsive to the digital chord note address signals for respectively providing a plurality of output frequency signals corresponding to the selected musical chord notes in the selected octaves; wherein the encoder includes a chord note control logic circuit for enabling the digital chord note address signals to be provided to individual chord note generators in accordance with the availability of the chord note generators; and a bass note assignment circuit for providing a bass note assignment signal coincident with the provision of the chord note address signal corresponding to a predetermined selected chord note.

The electronic musical instrument according to this aspect of the present invention includes a bass note generator connected to the chord note generators for receiving output frequency signals from the chord note generators, and responsive to the bass note assignment signal for reducing the frequency of the output frequency signal corresponding to the predetermined chord note by one octave to thereby provide a bass note output frequency signal. In accordance with this aspect of the present invention, there is no discontinuity in the bass note waveform by reason of changing chords when the same bass note is also provided for the new chord.

Additional features of the present invention are disclosed in the description of the preferred embodiment.

DESCRIPTION OF THE PREFERRED EMBODIMENT

Figure 1:
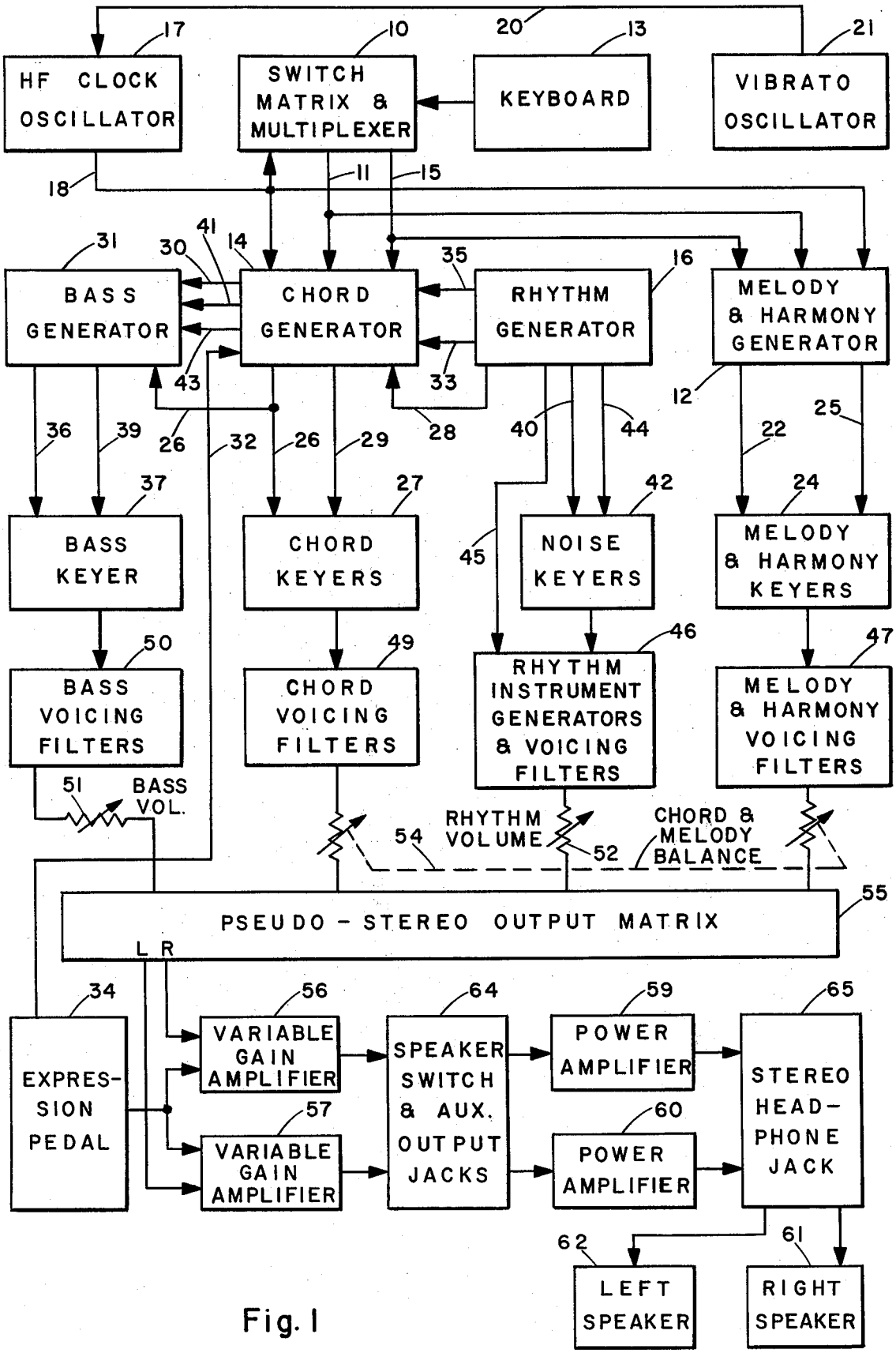
FIG. 1 is a block diagram of an electronic organ according to the present invention.

The present invention preferably is embodied in an electronic organ as shown in the Drawing. FIG. 1 is a block diagram of an electronic organ according to the present invention.

A switch matrix and multiplexer 10 provides a serial keyboard data signal on line 11 in response to the manipulation of the keys of the organ keyboard 13. The serial keyboard data signal is provided on line 11 to the melody and harmony generator 12 and the chord generator 14. The keyboard 13 has a plurality of keys for selecting predetermined musical notes in predetermined octaves.

The switch matrix and multiplexer 10 also provides a scan clock signal on line 15 to the melody and harmony generator 12 and the chord generator 14.

A high frequency clock oscillator 17 provides a high frequency clock signal on line 18 to the switch matrix and multiplexer 10, the melody and harmony generator 12 and the chord generator 14.

The scan clock signal on line 15 is derived from the high frequency clock signal received on line 18 by the switch matrix and multiplexer 10.

When desired, the high frequency clock signal on line 18 can be frequency modulated with a signal on line 20 from a vibrato oscillator 21 to produce a pleasing effect in the sounds generated by the organ.

The melody and harmony generator 12 provides output frequency signals corresponding to selected melody and harmony notes in selected octaves on lines 22 to melody and harmony keyers 24, and further provides note gate signals on line 25 for gating the melody and harmony keyers 24 to respond to the output frequency signals on lines 22. The melody and harmony note output frequency sounds are generated in response to manipulation of the keys on the right hand portion of the keyboard 13.

The chord generator 14 provides output frequency signals corresponding to selected musical chord notes in selected octaves on line 26 to the chord keyers 27, and also provides chord gate signals on lines 29 for gating the chord keyers 27 to respond to the output frequency signals on lines 26. The chord gate signals are enabled by either a rhythm signal on line 28 from the rhythm generator 16 when the organ is not being operated in a rhythm mode or by a chord trigger signal on line 33 from the rhythm generator 16 when the organ is being operated in the rhythm mode. The chord note output frequency signals on line 26 are generated in response to manipulation of the keys on the left hand portion of the keyboard and in accordance with signals received on lines 32 from an expression pedal 34.

The chord generator 14 provides bass note assignment signals on line 30 to a bass generator 31 in accordance with signals received on line 28 and on lines 35 from the rhythm generator 16. Bass note assignment is further determined by the state of signals received by the bass generator 31 on lines 26, lines 41 and lines 43 from the chord generator 14. The bass generator 31 provides an output frequency signal corresponding to a selected bass note on line 36 to a bass keyer 37, and also provides a bass gate signal on line 39 to the bass keyer 37 for gating the bass keyers to respond to the output frequency signal on line 36.

The rhythm generator 16 provides an output frequency signal corresponding to predetermined noises on line 40 to noise keyers 42 and further provides noise gate signals on lines 44 for enabling the noise keyers 42 to respond to the output frequency signals on line 40. The rhythm generator 16 also provides multiple output pulse signals on lines 45 to a rhythm instrument generators and voicing filters circuit 46. The rhythm instrument generators 46 synthesize the non-tuned sounds corresponding to percussion instruments, such as drums and cymbals, which are imitative of a drummer. The rhythm generator 16 controls the rhythmic sounding of the sounds corresponding to the non-tuned percussion instruments, the chord notes, the bass note. The rhythm generator 16 also includes an adjustable oscillator for controlling the tempo or repeat rate and a noise generator for providing the output frequency signals that are processed by the rhythm instruments generator 46.

The keyers 24, 27, 37 and 42 amplitude modulate the output frequency signals received on lines 22, 26, 36 and 40 from the melody and harmony generator 12 the chord generator 14, the base generator 31 and the rhythm generator 16 respectively.

The melody and harmony voicing filters 47, the chord voicing filters 49, the bass voicing filter 50 and the voicing filters in circuit 46 transform the amplitude-modulated signals from the keyers 24, 27, 37 and 42 respectively into their final output forms. It is these filters 47, 49, 50 and 46 which determine if the sound will be flute-like, string-like, etc.

Bass and rhythm volume controls 51 and 52 and the chord and melody balance controls 54 are provided to enable the user to balance the relative volume levels of the melody, chord, bass and rhythm instrument voices. Since some voices are soft and others loud, the settings of these controls 51, 52 and 54 will depend on the voices selected and user preference.

A pseudo-stereo output matrix 55 provides a means of combining the various signals from the voicing filters 46, 47, 49, 50 into two channels crudely imitative of stereo sound. In this manner, various voices may be made to apparently emanate from different places.

Two variable-gain amplifiers 56 and 57 are controlled by the expression-pedal 34 to vary the over-all loudness of the organ.

The organ also includes power amplifiers 59 and 60 and speakers 61 and 62. A "speaker switch and auxilliary output jacks" 64 and a stereo headphone jack 65 also are provided.

Except for the switch matrix and multiplexer 10, the melody and harmony generator 12, the chord generator 14 and the bass generator 31, the components of the organ shown in FIG. 1 are well known to those skilled in the art and will not be further discussed herein.

Figure 2:
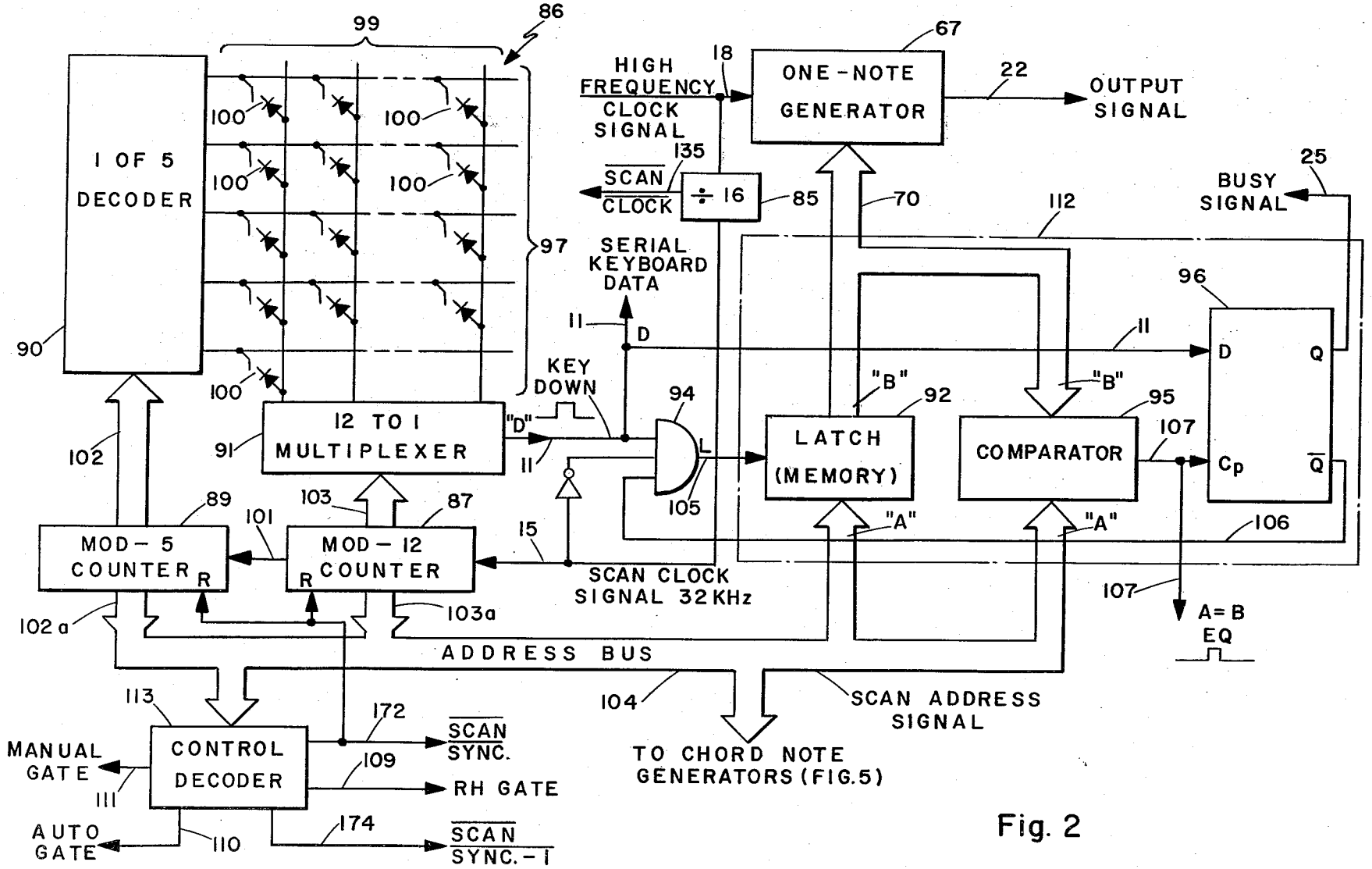
FIG. 2 is a schematic circuit and block diagram of the switch matrix and multiplexer and a portion of the melody and harmony generator included in the electronic organ shown in FIG. 1.

The encoder of the electronic organ of the present invention includes the switch matrix and multiplexer 10 and portions of the melody and harmony generator 12, the chord generator 14 and the bass generator 31. Portions of the encoder are shown in FIG. 2. Only a single melody and harmony note generator 67 is included in FIG. 2 for simplicity of illustration; it being understood that in the preferred embodiment there are a plurality of melody and harmony note generators. The melody and harmony note generator 67 is included in the melody and harmony generator 12.

Figure 3:
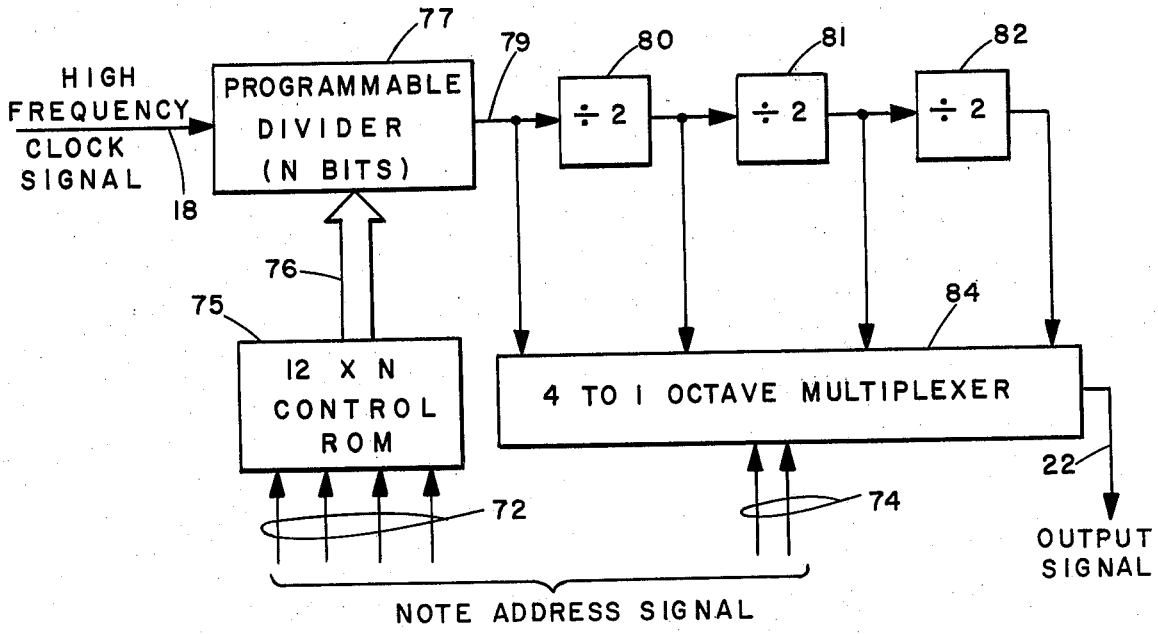
FIG. 3 is a schematic block diagram of an improved note generator according to the present invention for use in the melody and harmony generator and the chord generator included in the electronic organ shown in FIG. 1.

The one-note generator 67 is shown in greater detail in FIG. 3. The output frequency signal is provided on line 22 in response to a note address signal provided on bus 70 (FIG. 2) by the encoder.

The digital note address signal on bus 70 is provided in response to manipulation of the keys on the keyboard 13. The least significant bits of the note address signal (which are provided on lines 72) indicate a predetermined musical note and the most significant bits of each note address signal (which are provided on lines 74) indicate a predetermined octave. The note generator includes a control ROM 75 that is responsive to the least significant bits on lines 72 of the note address signal for providing a note control signal on bus 76; and a programmable divider 77 that is reponsive to the note control signal on bus 76 for dividing the high frequency clock signal received on line 18 to provide a signal on line 79 corresponding to the predetermined musical note selected by manipulation of a key on the keyboard 13. The note generator 67 also includes a plurality of frequency dividers 80, 81 ad 82 connected in series to the output of the programmable divider 77 for providing from their respective outputs a plurality of signals corresponding to the selected musical note in successively lower octaves; and an octave multiplexer 84 that is responsive to the most significant bits on lines 74 of the note address signal for selecting one of the plurality of signals from the programmable divider 77 and the plurality of series connected frequency dividers 80, 81 and 82 to provide an output frequency signal corresponding to the selected musical note in the selected octave on line 22.

Referring again to FIG. 2, the encoder includes a clock circuit 85, a keyswitch matrix 86, a first counter 87, a second counter 89, a decoder 90, a multiplexer 91, a memory 92 and a control logic circuit which includes a first logic gate 94, a comparator 95 and a busy signal generator 96.

The preferred embodiment of the electronic organ is designed for providing four complete octaves of musical notes. An octave includes eight musical notes from low C to high C and also the five sharp notes of low C, D, F, G, and A. However, high C of the octave is also low C of the next higher octave. Thus only the twelve lower notes (not including high C) are included in an octave as the term is used herein to refer to the structure and operation of the electronic organ of the present invention. Thus, the keyboard 13 includes forty-nine keys, with forty-eight of the keys being provided for selecting the lower twelve notes in each of four different octaves, and the forty-ninth key being provided for selecting high C in the fourth octave.

The clock circuit 85 includes a "divide by 16" frequency divider which divides an approximately 512 KHz high frequency clock signal on line 18 to provide an approximately 32 KHz pulsed scan clock signal on line 15.

The keyswitch matrix 86 is connected to the keyboard 13. The matrix 86 includes twelve columns of conductors 97 and five rows of conductors 99, and forty-nine keyswitches 100. Each of the keyswitches 100 is arrayed in the matrix 86 for connecting a conductor 97 of a given row to a conductor 99 of a given column in response to the manipulation of a given key in the keyboard 13. The twelve columns 99 correspond to the twelve lower notes in an octave and the five rows 97 correspond to the four octaves plus the fifth octave containing high C of the fourth octave.

The first counter 87 is a MOD-12 counter which is connected to the clock circuit 85 for counting the pulses in the scan clock signal on line 15 to provide a count on buses 103 and 103*a* corresponding to the notes in the twelve note octave and to also provide a pulsed signal on line 101 corresponding to the scan clock sigal on line 15 divided by twelve.

The second counter 89 is a MOD-5 counter which is connected to the first counter 87 for counting octaves. The counter 89 provides a count of the octaves on buses 102 and 102*a*.

The decoder 90 is a "one-of-five" decoder, which is connected to the rows 97 of the keyswitch matrix 86 and to the second counter 89 for sequentially providing pulses in the five rows 97 of the keyswitch matrix 86 corresponding to the octave count.

The multiplexer 91 is a "twelve-to-one" multiplexer, which is connected to the columns 99 and to the first counter 87 for scanning the columns 99 of the keyswitch matrix 86 at the rate of the scan clock signal on line 15 to thereby provide a serial keyboard data signal on line 11. The serial keyboard data signal on line 11 includes pulses provided from the keyboard matrix 86 in response to manipulation of the keys of the keyboard 13. Each pulse in the serial keyboard data signal on line 11 corresponds to a selected musical note in a selected octave.

The memory 92 is a latch circuit, which is connected to the first and second counters 87, 89 for receiving a digital scan address signal on address bus 104. In the scan address signal, the least significant bits are received from the first counter 87 and correspond to the notes corresponding to the first columns 90 in the keyswitch matrix 86, and the most significant bits are received from the second counter 89 and correspond to the octaves corresponding to the rows 97 in the keyswitch matrix 86.

The logic gate 94 is enabled by a data pulse "D" in the serial keyboard data signal provided on line 11 when a key in the keyboard 13 is pressed down, for enabling the memory 92 to store the scan address signal then present on the address bus 104.

The memory 92 is connected to the note generator 67 for providing the stored scan address signal to the note generator 67 on bus 70 as the note address signal.

The busy signal generator 96 is coupled to the memory by the comparator 95 and is responsive to the data pulse D in the serial keyboard data signal on line 11 that enabled the memory 92 to store the scan address signal on bus 104 for generating busy signals on line 25 and line 106 for so long as the key that was pressed down to provide the pulse D continues to be pressed down. The busy signal on line 25 is the logical compliment of the busy signal on line 106.

The gate logic 94 is inhibited by the busy signal on line 106 from enabling the memory 92 to store the scan address signal on bus 104 in response to a subsequent pulse in the serial keyboard data signal on line 11.

The comparator 95 compares the stored contents "B" of the memory 92 on bus 70 with the scan address signal "A" on bus 104.

The busy signal generator 96 is a D flip-flop having its D input connected to receive the serial keyboard data signal on line 11 and its clock input connected to the output of the comparator 95 via line 107. A logic "1" (high level) busy signal is provided on line 25 from the Q output of the D flip-flop 96, and a logic "0" (low level) busy signal is provided on line 106 from the $\overline{Q}$ output of the flip-flop 96 in response to the pulse D that enabled the memory to store the scan address signal on bus 104 being provided when the comparator output signal on line 107 for clocking the D flip-flop 96 has a high level pulse "EQ" thereby indicating that the scan address signal "A" equals the stored contents "B" of the memory 92. The busy signal is removed from the Q and $\overline{Q}$ outputs of the D flip-flop 96 in response to the enabling pulse "D" not being provided when the comparator 96 output signal on line 107 next indicates that the scan address signal A equals the stored contents B of the memory 92.

Figure 4:
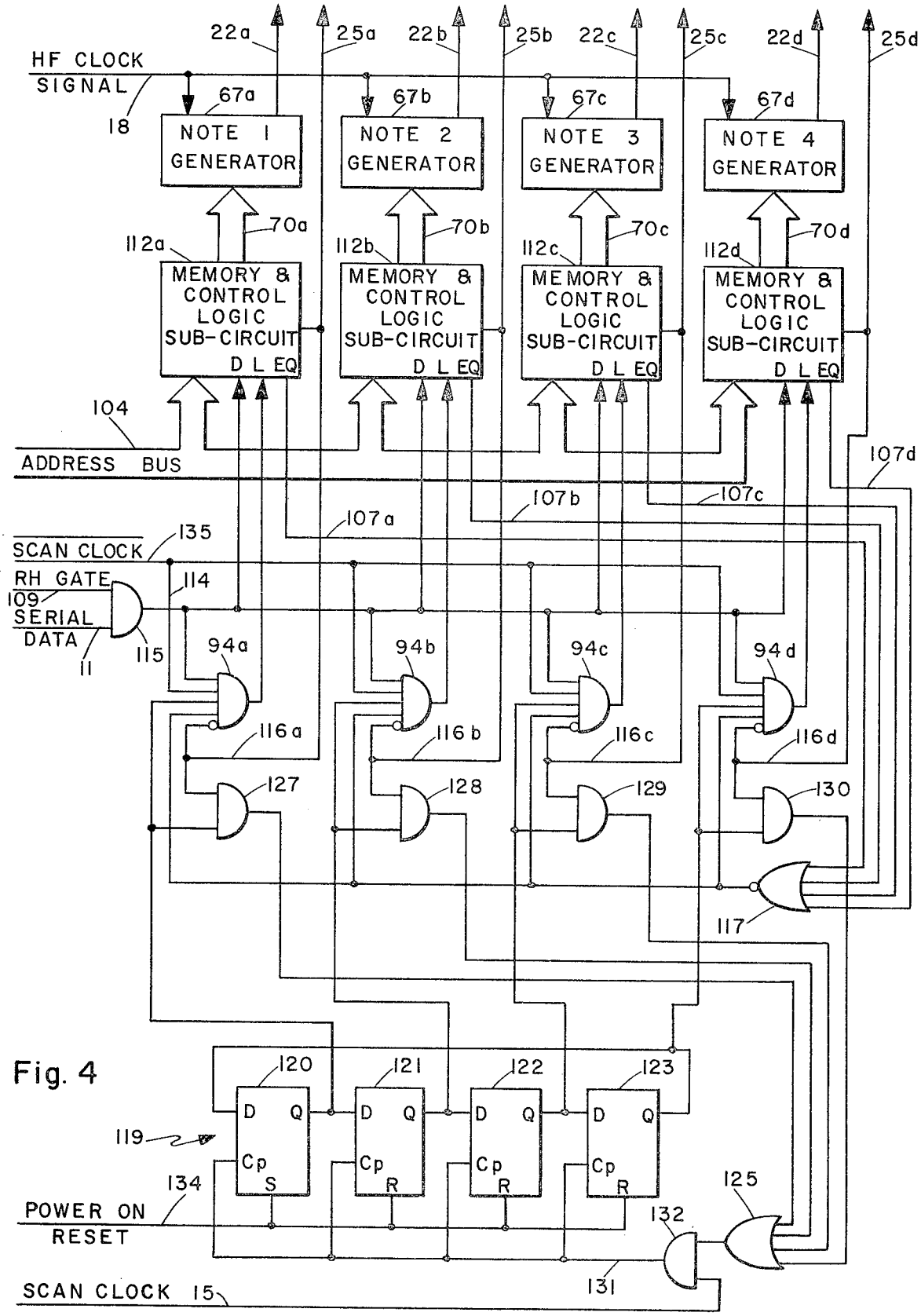
FIG. 4 is a schematic block and circuit diagram showing a control logic circuit for assigning note generators in accordance with their availability in accordance with the present invention for use in the melody and harmony generator and the chord generator included in the electronic organ shown in FIG. 1.

Referring to FIG. 4, in the preferred embodiment of the electronic organ of the present invention, the melody and harmony generator 12 includes four note generators 67*a*, 67*b*, 67*c*, and 67*d*, so that four melody and harmony notes can be produced at the same time.

The keys of the keyboard 13 that produce the melody and harmony notes are arranged so as to be played with the right hand; whereas the keys of the keyboard 13 that produce the chord notes are arranged to be played with the left hand. When the electronic organ is operated in an automatic chord mode, chords may be played by manipulating any one of the lowest twelve note keys on the keyboard 13, whereby the remaining thirty-seven notes are then available for right hand playing.

When the organ is operated in a manual chord mode, chords are played by manipulating an appropriate number of the lowest seventeen note keys on the keyboard 13, whereby the remaining thirty-two notes are then available for right hand playing. In the automatic chord mode a right hand gate signal "RH GATE" is provided on line 109 coincident with any of the 37 right hand keys being played and an "AUTO GATE" signal is provided on line 110 (FIG. 6) coincident with any of the 12 left hand keys being played. In the manual chord mode the RH GATE signal is provided on line 109 coincident with any of the 32 right hand keys being played and a "MANUAL GATE " signal is provided on line 111 (FIG. 6) coincident with any of the 17 left hand keys being played.

Accordingly a serial keyboard data signal is provided from line 11 onto line 114 only when a RH GATE signal is provided to AND gate 115.

The signals on lines 109, 110 and 111 are derived from the scan address signal on bus 104 by a control decoder circuit 113 (FIG. 2).

Corresponding to the four note generators 67*a*, 67*b*, 67*c*, and 67*d*, (FIG. 4) there are four memories, four comparators and four busy signal generators; which are included in "memory and control logic sub-circuits" 112*a*, 112*b*, 112*c*, and 112*d*, respectively. Each of these sub-circuits is identical to the memory and control logic sub-circuit 112 as shown in FIG. 2. The memories in sub-circuits 112*a*, 112*b*, 112*c*, and 112*d* provide stored digital scan address signals from address bus 104 to the note generators 67*a*, 67*b*, 67*c*, and 67*d* as note address signals on buses 70*a*, 70*b*, 70*c* and 70*d* in the same manner as described above in connection with FIG. 2.

The control logic circuit of the encoder is responsive to the serial keyboard data signal on line 114 for enabling the digital scan address signals on bus 104 to be stored into the individual memories in sub-circuits 112*a*, 112*b*, 112*c* and 112*d* in accordance with the manipulation of the right hand keys on the keyboard 13 and in accordance with the availability of the note generators 67*a*, 67*b*, 67*c* and 67*d*. The control logic circuit includes four first logic gates 94*a*, 94*b*, 94*c*, and 94*d* respectively connected to the memories in sub-circuits 112*a*, 112*b*, 112*c* and 112*d*. Each first logic gate is enabled by a pulse in the keyboard data signal on line 114 for enabling the connected memory to store the scan address signal then present on the bus 104. Each of the busy signal generators in the sub-circuits 112*a*, 112*b*, 112*c* and 112*d* respectively responds to the pulse in the serial keyboard data signal on line 114 that enabled the coupled memory to store the scan address signal from bus 104 by generating a busy signal on lines 25*a*, 25*b*, 25*c* and 25*d* and on lines 116*a*, 116*b*, 116*c* and 116*d* for so long as the key that was manipulated to provide such pulse continues to be manipulated. The busy signals provided on lines 25*a*, 25*b*, 25*c* and 25*d* are the gate signals provided to the melody and note keyers 24 (FIG. 1). Each of the first logic gates 94*a*, 94*b*, 94*c*, 94*d* respectively connected to the coupled memory is responsive to the busy signal on line 116*a*, 116*b*, 116*c*, 116*d* respectively for inhibiting the coupled memory from storing the scan address signal from bus 104 in response to a subsequent pulse in the serial keyboard data signal on line 114.

Each of the four comparators in the sub-circuits 112*a*, 112*b*, 112*c*, 112*d* respectively compares the stored contents on bus 70*a*, 70*b*, 70*c*, 70*d* from the connected memory with the scan address signal on bus 104 and provides a note taken signal "EQ" on line 107*a*, 107*b*, 107*c*, 107*d* when the scan address signal on bus 104 equals the stored contents on bus 70*a*, 70*b*, 70*c*, 70*d* from the connected memory.

A second logic gate 117 is connected to the comparators in sub-circuits 112*a*, 112*b*, 112*c*, 112*d* and provides a signal to the first logic gates 94*a*, 94*b*, 94*c*, 94*d* for inhibiting the first logic gates from enabling storage of the scan address signal from the bus 104 in the respectively connected memories whenever a note taken signal EQ is provided on any of the lines 107*a*, 107*b*, 107*c*, 107*d* from the comparators. This prevents a given note address signal from being provided to more than one note generator 67*a*, 67*b*, 67*c*, 67*d*.

The control circuit also includes a shift register 119. The shift register 119 has four output stages 120, 121, 122, 123, with the outputs of the four stages being respectively connected to the first logic gates 94*a*, 94*b*, 94*c*, 94*d* for sequentially providing an enabling signal from only one of the output stages to the connected first logic gate to enable the scan address signal on bus 104 to be stored in only one connected memory in response to a single pulse in the serial data keyboard signal on line 114.

A third logic gate 125 is connected via AND gates 127, 128, 129, 130 to the four output stages of the shift register 119 and the four busy signal lines 107*a*, 107*b*, 107*c*, 107*d*. The third logic gate 125 responds to the busy signal generated from the busy signal generator, that is connected to the memory that was enabled for storing the said scan address signal in response to the enabling signal from the one output stage that provides an enabling signal at any one time, to thereby shift the shift register 119 to provide the enabling signal from a different output stage. The shift register 119 is shifted by a signal on line 131 from an AND gate 132 when the busy signal provided from the third logic gate 125 occurs during a SCAN CLOCK signal pulse on line 15. The shift register 119 is initialized by a "power-on reset" signal on line 134.

A $\overline{\text{SCAN CLOCK}}$ signal, which is the logical compliment of the SCAN CLOCK signal, is provided on line 135 to the four first logic gates 94*a*, 94*b*, 94*c*, 94*d* to inhibit the first logic gates during those intervals that the shift register 119 is being shifted. This prevents more than one of the first logic gates from being enabled simultaneously and thus prevents the same note address signal from being provided to more than one note generator 67*a*, 67*b*, 67*c*, 67*d*. The $\overline{\text{SCAN CLOCK}}$ signal on line 135 is provided from the clock circuit 85 (FIG. 2).

Figure 5:
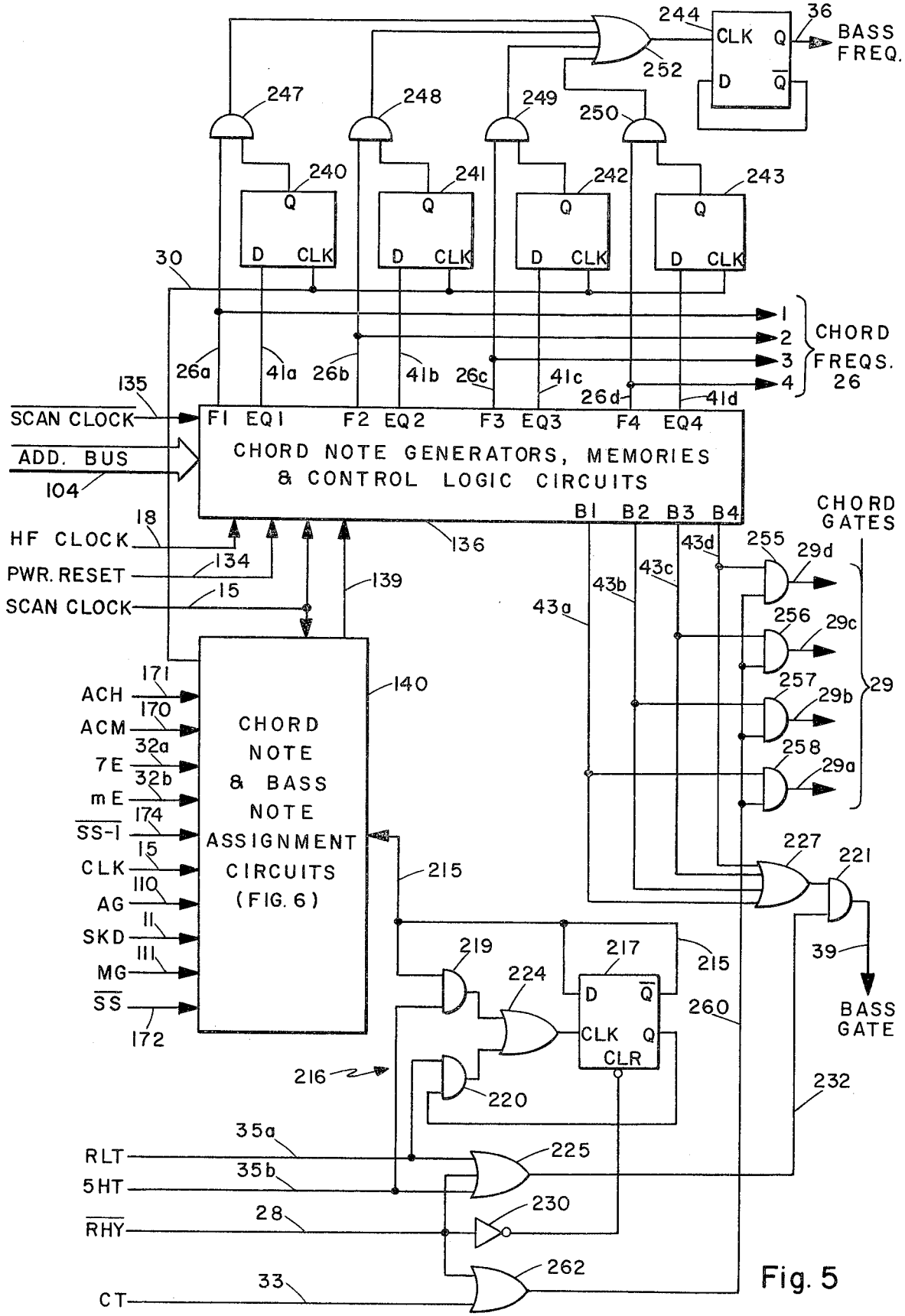
FIG. 5 is a schematic and block diagram of the chord generator and bass generator included in the electronic organ shown in FIG. 1.

In the preferred embodiment of the electronic organ of the present invention, the chord generator 14 includes four chord note generators. Referring to FIG. 5, the four chord note generators are included in a "chord note generators memories and control logic circuits module" 136. These components of the module 136 are connected together and function in the same manner as the like components in the melody and harmony generator 12 shown in FIG. 4 and described in relation thereto. It is noted that like the circuit of the FIG. 4, the components in the module 136 also respond to a $\overline{\text{SCAN CLOCK}}$ signal on line 135, a scan address signal on bus 104, a high frequency clock signal on line 18, a power reset signal on line 134 and a SCAN CLOCK signal on line 15. The only difference from the circuit of FIG. 4, is that instead of responding to a serial keyboard data signal on line 114 derived from manipulation of the keys on the right hand of the keyboard 13, (as in FIG. 4), the module 136 responds to a serial chord data signal on line 139 from a "chord note and bass note assignment circuit module" 140. A schematic circuit diagram of the module 140 is provided in FIG. 6.

The chord note assignment circuit includes an eleven bit shift register 141; three D flip-flops 142, 144 and 145; AND gates 146, 147, 148, 149, 150, 151, 152, 153, 154; OR gates 157, 158, and 159; NAND gates 162, 163, and 164; NOR gates 167 and 168; a three bit MOD-5 counter 175, and a "state 5 (code 4)" decoder 179.

An automatic chord mode signal is provided on line 170 from a switch on the organ console (not shown) when it is desired to operate the organ in the automatic chord mode. An automatic chord hold signal is provided on line 171 from a switch on the organ console (not shown). A signal on line 171 enables the chord note assignment circuit to remember the last chord that was played in the automatic chord mode.

A $\overline{\text{SCAN SYNC}}$ signal is provided on line 172 from the control decoder circuit 113 (FIG. 2). This signal provides a pulse each time the keyswitch matrix 86 is scanned by the counters 87 and 89, thereby completing a "scan frame". The pulse occurs at the end of the scan. The $\overline{\text{SCAN SYNC}}$ signal on line 172 is derived from the scan address signal on bus 104 by the control decoder 113. The $\overline{\text{SCAN SYNC}}$ signal synchronizes the operation of the assignment circuits 140 with the serial keyboard data provided thereto on line 11.

A $\overline{\text{SCAN SYNC-1}}$ signal on line 174 also is provided by the control decoder 113 from the scan address signal on bus 104. Like the $\overline{\text{SCAN SYNC}}$ signal on line 172, the $\overline{\text{SCAN SYNC-1}}$ signal on line 174 occurs once during each scan of the matrix 86, but it occurs exactly one time slot ("−1") before the $\overline{\text{SCAN SYNC}}$ pulse. A time slot is defined by the period of the scan clock signal provided by the scan clock circuit 85. Because the $\overline{\text{SCAN SYNC}}$ signal pulse on line 172 is used to reset some circuit components that contain data that is processed in the next scan frame, such as the count in the counter 175, the $\overline{\text{SCAN SYNC-1}}$ signal pulse on line 174 enables such data to be sampled prior to its destruction.

The derivation of the scan clock signal on line 15, the AUTO GATE signal on line 110, the serial keyboard data signal on line 11 and the MANUAL GATE signal on line 111 have been discussed hereinabove.

First consider the "automatic chord" mode of operation, wherein four chord notes are automatically assigned in response to selection of a single chord note key among the twelve keys at the left hand of the keyboard 13. The auto chord mode signal on line 170 is then high (logic 1).

At the end of each scan frame the $\overline{\text{SCAN SYNC-1}}$ signal on line 174 clears the flip-flop 142. This enables the chord note assignment circuit for the next scan frame.

During the twelve time slots allocated for the twelve chord notes in the automatic chord mode, the AUTO GATE signal on line 110 is high and the serial keyboard data signal on line 11 is passed through AND gate 146 and OR gate 157 to NAND gate 162. NAND gate 162 is enabled during the last half (or low level) of each time slot of the scan clock signal on line 15. The decoder 179 provides a low (logic "0") signal on line 180 during the automatic chord mode.

When a pulse occurs in one of these twelve time slots of the serial keyboard data signal on line 11, the signal on line 181 goes low, which results in the application of a low level signal to NOR gates 167 and 168 and to the clock input of flip-flop 142. At the end of this time slot the signal on line 181 again becomes high, thereby clocking the flip-flop 142 such that its Q output becomes high. Note that immediately prior to the Q output of flip-flop 142 going high, the NOR gate 167 had been enabled by the signal on line 181 to provide a high level signal on line 182. However, after the Q output of the flip-flop 142 goes high the signal on line 182 again goes low and can not go high again until the next scan frame (i.e. after the $\overline{\text{SCAN SYNC-1}}$ signal on line 174 again clears the flip-flop 142). By this method, the first serial keyboard data pulse that occurs in the twelve chord note time slots is stripped off for processing, and any others that may occur later within the same scan frame are ignored. Thus the chord note assignment circuit responds to only the first chord note pulse that occurs in the keyboard serial data signal on line 11. This pulse corresponds to the root note of the automatic chord.

Since the AND gate 149 already has a high input signal on line 170, the high signal pulse generated on line 182 is passed by the AND gate 149 and the OR gate 158 to the D input of the D flip-flop 144. The flip-flop 144 is in effect the first stage of a twelve bit shift register consisting of the flip-flop 144 and the eleven bit shift register 141. Since the flip-flop 144 and the eleven bit shift register 141 are both clocked by the scan clock signal on line 15, the next positive going transition of the scan clock signal on line 15 transfers the high level signal at the D input of flip-flop 144 from line 182 to the Q output of the flip-flop 144. The high level signal on line 182 also clears the eleven bit shift register 141, thereby assuring that automatic chord generation is responsive to only one chord note pulse (i.e. the root note pulse) in any given scan frame.

At the same time as the eleven bit shift register 141 is cleared, the flip-flop 145 also is cleared. The flip-flop 145 is cleared by a low level signal on line 184 that is provided from NAND gate 164 when a high level signal is provided on line 185 from the NOR gate 158 in response to the high level signal pulse on line 182.

The high level signal pulse on line 185 also passes through NOR gate 159 to provide a high level signal on line 186 to one input of AND gate 154. Since a low level signal is provided on line 187 from the Q output of the flip-flop 145 upon the flip-flop 145 being cleared, the NAND gate 163 also provides a high level signal on line 189 to the other input of AND gate 154, thereby enabling the pulse on line 185 to be passed through the AND gate 154 onto line 139 as the first pulse in the serial chord data signal.

Upon the positive going transition of the next clock pulse in the scan clock signal on line 15 (i.e. the second scan clock pulse after the occurance of the high level signal on line 182), the high level signal pulse at the Q output of flip-flop 144 is transferred into the first stage of the eleven bit shift register 141 and is provided at the Q1 output of the shift register 141. Upon succeeding clock pulses of the scan clock signal on line 15, the high level signal pulse is successively provided at the Q2, Q3, Q4, Q5, Q6, Q7, Q8, Q9, Q10, and Q11 outputs of the shift register 141. This high level signal pulse occurs at only one of the outputs of the shift register 141 during any one pulse interval of the scan clock signal on line 15.

Figure 7:
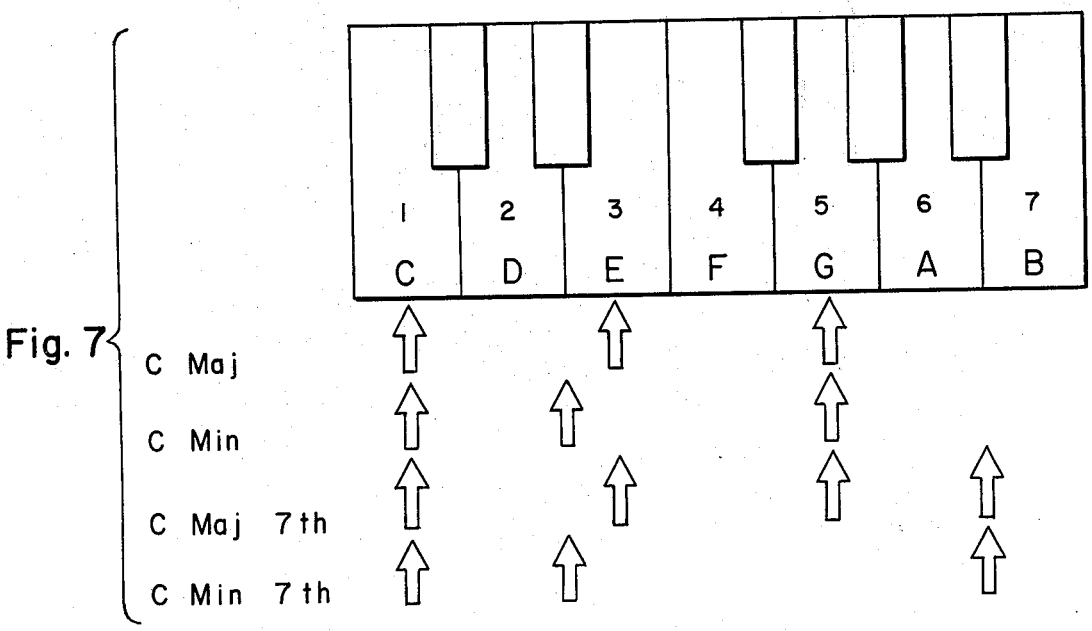
FIG. 7 illustrates the selection of chord notes in four different chords in the key of C as provided by the chord note assignment circuit of FIG. 6.

FIG. 7 illustrates which notes are automatically selected in a C chord. In a C major chord, low level signals are provided on lines **32*a* and 32*b* from the expression pedal 34. A 7th note enable signal "7E" is provided on line 32*a* when it is desired that the automatically generated chord include four notes instead of three. A minor enable signal "mE" is provided on line 32*b*** when a minor chord is desired.

Figure 6:
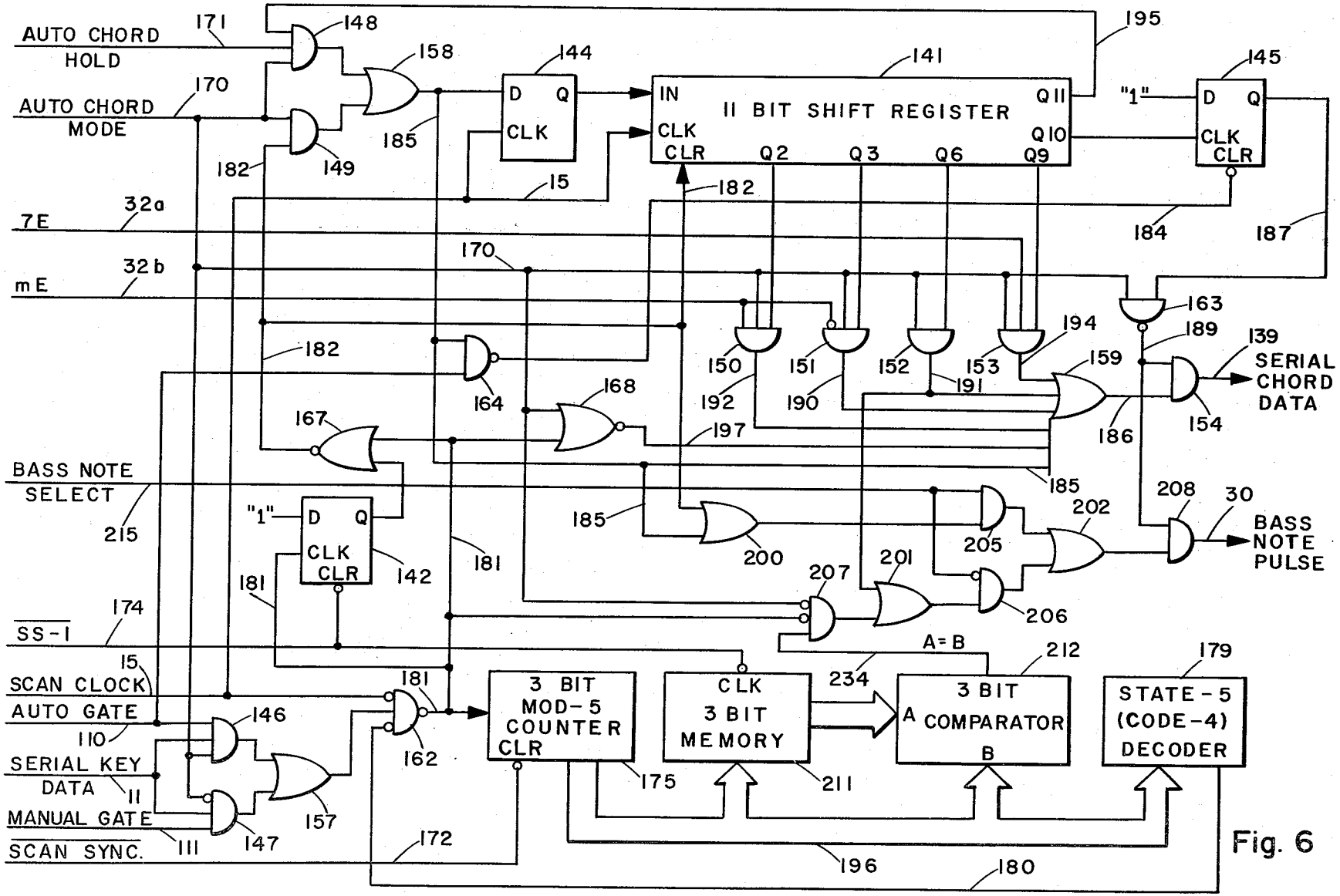
FIG. 6 is a schematic circuit and block diagram of the chord note and bass note assignment circuits according to the present invention, and as represented by a block in FIG. 5.

Referring to both FIGS. 6 and 7, the high level signal that occurs on line 185 results in the selection of note C.

In all major chords, a high level signal pulse is provided on line 190 from AND gate 151 upon the positive going transition of the fourth pulse of the scan clock signal on line 15 that occurs following the occurrence of the pulse on line 185. The positive going transition of this fourth clock pulse causes a high level signal to be provided from the Q3 output of the shift register 141, which in turn causes gate 151 to provide a high level signal pulse on line 190 through OR gate 159 and AND gate 154 onto the line 139 as part of the serial chord data signal. The high level signal pulse that occurs on line 190 during a C chord results in the selection of note E. (See FIG. 7).

When a high level pulse is provided from the Q6 output of the shift register 141, a high level signal pulse is provided on line 191 from the output of AND gate 152 and is furnished through the OR gate 159 and the AND gate 154 to become part of the serial chord data signal on line 139. The high level signal pulse that occurs on line 191 during a C chord results in the selection of note G. (See FIG. 7).

When a high level signal is present on line **32*b*, thereby indicating a minor chord, and the root note is again C the signals that are delivered on lines 182 and 191 again result in the selection of the notes of C and G as in the case of the C major chord discussed above. However, instead of a high level signal pulse being delivered from AND gate 151 to designate an E note, a high level signal pulse is delivered on line 192 from AND gate 150 to designate an E flat note. This is because the high level signal on line 32*b* inhibits the AND gate 151 from responding to the high level signal pulse that occurs at the Q3 output of the shift register 141, but instead enables the AND gate 150 to respond to the high level signal pulse that occurs at the Q2 output of the shift register 141 one time slot earlier. During major chord modes the low level signal on line 32*b* inhibits AND gate 150 and enables AND gate 151**.

When a high level signal is present on line **32*a*, thereby indicating that the chord has four notes, a high level signal pulse is delivered on line 194 from AND gate 153 when a high level signal pulse is provided at the Q9 output of the shift register 141. The high level signal pulse on line 194 is provided through OR gate 159 and AND gate 154 to become part of the serial chord data signal on line 139. During C chords the high level signal pulse on line 194** results in the selection of the note B flat. FIG. 7 illustrates which notes are selected in major and minor C chords having four notes.

When a high level signal pulse is eventually provided at the Q10 output of the shift register 141, the flip-flop 145 is clocked to provide a logic 1 (high level) signal on line 187 to thereby drive the signal on line 189 low and inhibit any further signal pulses from being delivered through AND gate 154 onto line 139 during the present scan frame.

Upon the next clock pulse, a high level pulse is provided from the Q11 output of register 141 onto line 195. If the auto chord hold signal on line 171 is high, this pulse on line 195 is circulated through AND gate 148 and OR gate 158 to initiate regeneration of the same serial chord data signal on line 139 all over again during the next scan frame. Thus if the auot chord hold signal on line 171 is high, the chord will continue to sound, even if the key that was depressed to indicate the root note of the last played chord is released. Upon the next depression of a chord key, however, a high level signal pulse is again provided on line 182 (as explained hereinabove) and the shift register 141 and the flip-flop 144 are both cleared, thereby enabling a new chord note assignment sequence to begin.

In the manual chord mode, up to four notes are selected manually by individual depression of the appropriare ones of the seventeen keys at the left hand of the keyboard 13. The auto chord mode signal on line 170 is then low.

During the seventeen time slots allocated for the seventeen chord notes in the manual chord, the manual gate signal on line 111 is high, and the serial keyboard data signal on line 11 is passed through AND gae 147 and OR gate 157 to NAND gate 162. NAND gate 162 is enabled during the last half of each time slot of the scan clock signal on line 15. The decoder 179 provides a low level signal on line 180 until four chord note signal pulses in the serial keyboard data signal 11 have been passed through NAND gate 162 onto line 181. Upon the fourth chord note signal pulse being so provided, the decoder 179 provides a high level signal on line 180 to inhibit any additional pulses from being passed through the NAND gate 162 during the same scan frame.

When a chord note pulse is passed through NAND gate 162, the signal on line 181 goes low. The counter 175 counts the number of chord note pulses provided on line 175 and provides this count on bus 196. The decoder 179 responds to the count on bus 196 and provides a high level signal on line 180 when this count reaches four.

When the signal on line 181 goes low in response to a chord note pulse in the serial keyboard data signal 11, a high level signal is provided from NOR gate 168 on line 197, and delivered through the OR gate 159 and the AND gate 154 onto line 139 as a part of the serial chord data signal. Because there is a low level signal on line 170 continuously during the manual chord mode, a high level signal is continuously provided on line 189 from NAND gate 163. Thus AND gate 154 passes all of the signal pulses received on line 186 directly onto line 139 while in the manual chord mode.

The base note assignment circuit includes OR gates 200, 201, and 202; AND gates 205, 206, 207, and 208; a three bit memory 211; and a three bit comparator 212, in addition to certain of the components that are also part of the chord note assignment circuit, as discussed hereinabove.

The bass note assignment circuit provides a bass note assignment signal on line 30 coincident with the provision of a chord note address signal that corresponds to a predetermined selected chord note. In the automatic chord mode, a bass note assignment signal is always provided on line 30 coincident with the provision of a chord note signal pulse corresponding to the root note in the serial chord data signal on line 139. The root note signal pulse is provided on line 139 from line 182. If the organ is in a rhythm mode as well as being in the automatic chord mode a bass note assignment signal also is provided on line 30 coincident with the provision of a chord note signal pulse on line 139 from line 191 corresponding to the fifth note in the octave.

In the manual chord mode, a bass note assignment signal is always provided on line 30 coincident with the provision of a chord note signal pulse corresponding to the lowest note in the chord represented by the serial chord data signal on line 139. The keyboard 13, the keyboard switch matrix 86, the multiplexer 91 and the decoder 90 are so arranged that successively higher notes are represented in successive time slots of the serial keyboard data signal on line 11. Thus the first chord note pulse provided in the serial keyboard data signal on line 11 in a given scan frame corresponds to the lowest note in the chord then being played.

If the organ is in a rhythm mode as well as being in the manual chord mode, a bass note assignment signal also is provided on line 30 coincident with the provision of the highest note in the chord represented by the serial chord data signal being provided on line 139.

The bass note assignment circuit is responsive to the state of a bass note selection signal that is provided on line 215 from a bass note selection circuit 216 (FIG. 5). The bass note selection circuit 216 includes a D flip-flop 217; AND gates 219 and 220; OR gates 224 and 225; and an inverter 230.

The bass note selection signal on line 215 is provided from the $\overline{Q}$ output of the flip-flop 217.

The bass note selection circuit is responsive to the state of a root/low trigger "RLT" signal on line 35*a* and a fifth/high trigger "5HT" signal on line 35*b* from the rhythm generator 16. The RLT signal on line 35*a* and the 5HT signal on line 35*b* are high level trigger pulses that are provided by the rhythm generator 16 asynchronously with the scan clock signal on line 15.

The bass note selection circuit also is responsive to the $\overline{\text{RHYTHM}}$ signal on line 28 from the rhythm generator 16. The signal on line 28 is high when the organ is not being operated in the rhythm mode.

First consider the automatic chord mode with rhythm. When the RLT signal on line 35*a* goes high a high level signal is provided on line 232 from OR gate 225 to AND gate 221, and the bass note selection circuit causes the bass note selection signal on line 215 to be high.

Referring to FIG. 6, when the signal on line 185 goes high to provide the signal pulse in the serial chord data signal on line 139 corresponding to the root note, and the bass note selection signal on line 215 also is high, this signal pulse on line 185 also is passed through the OR gate 200, the AND gate 205, the OR gate 202 and the AND gate 208 to provide a bass note assignment signal pulse on line 30. Note that AND gate 205 is enabled by the high level of the bass note selection signal on line 215.

When the 5HT signal on line 35*b* goes high a high level signal is provided on line 232 from OR gate 225 to AND gate 221, and the bass note selection circuit 216 causes the bass note selection signal on line 215 to be low. Referring again to FIG. 6, when the signal on line 191 goes high to provide the signal pulse in the serial data signal on line 139 corresponding to the fifth note in the octave, and the bass note selection signal on line 215 is low, this signal pulse on line 191 also is passed through the OR gate 201, the AND gate 206, the OR gate 202 and the AND gate 208 to provide a bass note assignment signal pulse on line 30. Note that AND gate 206 is enabled by the low level of the bass note selection signal on line 215.

In the automatic chord mode of operation without rhythm, the $\overline{\text{RHYTHM}}$ signal on line 28 goes high thereby providing an enabling signal on line 232 from the OR gate 225 to the AND gate 221. Also both the RLT signal on line 35*a* and the 5HT signal on line 35*b* are low and the bass note selection signal on line 215 is high. Thus when operating in a non-rhythm mode, bass note assignment signal pulses are provided on line 30 only when the signal on line 185 goes high to provide signal pulses in the serial chord data signal on line 139 corresponding to the root note.

Consider now, the manual chord mode of operation, with rhythm. In this mode when the signal on line 181 goes low in response to the lowest (or first) chord note pulse in the serial keyboard data signal on line 11, the flip-flop 142 is toggled to provide a high level pulse signal at its Q output and thereby provide a high level signal pulse on line 182. When the RLT signal on line 35*a* also goes high to cause the bass note selection signal on line 215 to be high, the signal pulse on line 182 is passed through the OR gate 200, the AND gate 205, the OR gate 202, and the AND gate 208 to provide a bass note assignment signal pulse on line 30 coincident in time with the low chord note pulse signal in the serial chord data signal on line 139.

In the manual chord mode of operation without rhythm, the bass note selection signal on line 215 is high, and a bass note signal pulse is provided on line 30 in response to the pulse signal occuring on line 182 during the interval of the lowest chord note.

In the manual chord mode of operation with rhythm it is also necessary to provide a second bass note assignment signal during each chord when the 5HT signal on line 35*b* goes high to cause the bass note selection signal on line 215 to be low. To provide this second bass note assignment signal, the memory 211 stores the count of chord note pulses in the serial keyboard data signal 11 that are passed through NAND gate 162. This count is provided on bus 196 by the counter 175, as discussed hereinabove. This count is latched into the memory 211 at the end of each scan frame by the $\overline{\text{SCAN SYNC-1}}$ signal pulse on line 174. The comparator 212 compares the count "A" stored in the memory 211 with the count "B" present on the buss 196. When count A equals count B a high level signal pulse is provided on line 234 to AND gate 207 thereby indicating that the chord note pulse occuring during that time slot corresponds to the highest note in the chord.

When the 5HT signal on line 35*b* also goes high to cause the bass note selection signal on line 215 to be low, the high level signal pulse on 234 is passed through AND gate 207, OR gate 201, AND gate 206, OR gate 202, and AND gate 208 to provide a bass note assignment signal pulse on line 30 coincident in time with the high chord note pulse signal in the serial chord data signal on line 139.

The chord note generators, memories and control logic circuits 136 of the chord generator 14 respond to the serial chord data signal on line 139 in the same manner that the like circuits of the melody and harmony generator 12 respond to the serial keyboard data signal on line 114. Accordingly, the chord note logic circuit enables note address signals to be provided to individual chord note generators in accordance with the availability of the chord note generators.

The chord note generators provide output frequency signals on lines 26*a*, 26*b*, 26*c*, and 26*d* from outputs F1, F2, F3, and F4 respectively.

The chord generator logic control circuit provides "note taken" signals on lines 41*a*, 41*b*, 41*c*, and 41*d* from outputs EQ1, EQ2, EQ3, and EQ4 respectively.

The chord generator chord logic control circuit further provides gate signals on lines 43*a*, 43*b*, 43*c*, and 43*d*. These chord gate signals are passed through AND gates 255, 256, 257 and 258 onto lines 29*a*, 29*b*, 29*c*, and 29*d* respectively when these gates are further enabled by a high level signal on line 260 a high level signal is provided on line 260 when in the rhythm mode by a chord trigger signal on line 33, that is passed by OR gate 262. A high level signal is continuously provided on line 260 when in the non-rhythm mode by the $\overline{\text{RHYTHM}}$ signal on line 28, which also is passed through OR gate 262.

A bass gate signal is provided on line 39 from gate 221 whenever a chord gate signal is received by AND gate 221 via OR gate 227 from any of the line 43*a*, 43*b*, 43*c*, and 43*d* coincident with an enabling signal on line 232. As discussed hereinabove in connection with the bass note selection circuit 216, an enabling signal is provided on line 232 through OR gate 225 coincident with either an RLT signal on line 35*a* or an 5HT signal on line 35*b* when in the rhythm mode, or continuously from line 28 when in the non-rhythm mode.

The bass generator 31 includes five D flip-flops 240, 241, 242, 243 and 244; AND gates 247, 248, 249 and 250; and OR gate 252.

The bass note generator is connected to the chord note generators for receiving the output frequency signals from the chord note generators on lines 26*a*, 26*b*, 26*c* and 26*d*; and is responsive to the bass note assignment signal on line 30 for reducing the frequency of the output frequency signal corresponding to the chord note that is coincident with the bass note by one octave, to thereby provide a bass note output frequency signal on line 36.

The EQ outputs of the chord generator control logic circuits are respectively connected by lines 41*a*, *41b*, 41*c*, and 41*d* to flip-flops 240, 241, 242, and 243. Thus whenever a chord note output frequency signal is provided on line 26*a*, 26*b*, 26*c* or 26*d* from its respective output of the chord note generator, the "note taken" signal on the corresponding line 41*a*, 41*b*, 41*c* or 41*d* provides a high level signal to the D input of the flip-flop to which it is connected. Line 30 is connected to the clock input of all of the flip-flops 240, 241, 242, and 243. Thus whenever a bass note assignment signal is provided on line 30, the flip-flop connected to the EQ output corresponding to the coincident chord note output frequency signal is clocked to provide a high level signal at its Q output to thereby enable the AND gate 247, 248, 249 or 250 to which it is connected to pass the corresponding chord note output frequency signal on line 26*a*, 26*b*, 26*c* or 26*d* through OR gate 252 to the clock input of flip-flo 244. Flip-flop 244 is connected to divide the frequency of the signal received at its clock input by two to thereby provide a bass note output frequency signal on line 39 that is one octave lower than the coincident chord note output frequency signal on line 26*a*, 26*b*, 26*c* or 26*d*.

Having described my invention, I now claim:

1. An electronic musical instrument, comprising a keyboard having a plurality of keys for selecting predetermined musical notes in predetermined octaves;

an oscillator for providing a high frequency clock signal;

an encoder coupled to the keyboard for providing digital note address signals in response to manipulation of the keys on the keyboard, wherein the least significant bits of each said note address signal indicate a predetermined musical note and the most significant bits of each said note address signal indicate a predetermined octave;

a note generator responsive to said note address signal for providing an output frequency signal corresponding to said selected musical note in said selected octave, wherein the note generator includes a control ROM that is responsive to said least significant bits of said note address signal for providing a note control signal;

a programmable divider that is responsive to said note control signal for dividing said high frequency clock signal to provide a signal corresponding to said predetermined musical note;

a plurality of frequency dividers connected in series to the output of the programmable divider for providing from their respective outputs a plurality of signals corresponding to said selected musical note in successively lower octaves; and an octave multiplexer that is responsive to said most significant bits of said note address signal for selecting one of said plurality of series connected frequency dividers to provide said output frequency signal corresponding to said selected musical note in said selected octave; and wherein the encoder comprises a clock circuit for providing a pulsed scan clock signal;

a keyswitch matrix connected to the keyboard wherein the matrix includes columns and rows of conductors and a plurality of keyswitches, wherein each of the keyswitches is arrayed in the matrix for connecting the conductor of a given row to the conductor of a given column in response to said manipulation of a given key in the keyboard, and wherein the columns correspond to the notes in an octave and the rows correspond to a predetermined number of octaves;

a first counter connected to the clock circuit for counting the pulses in said scan clock signal to provide a count corresponding to said notes;

a second counter connected to the first counter for counting multiples of said number of notes in a octave to provide a count of said octaves;

a decoder connected to the rows of the keyswitch matrix and to the second counter for sequentially providing pulses in the rows of the keyswitch matrix corresponding to said octave count;

a multiplexer connected to the columns of the keyswitch matrix and to the first counter for scanning the columns of the keyswitch matrix at the rate of said scan clock signal to thereby provide a serial keyboard data signal including pulses provided from the keyswitch matrix in response to manipulation of the keys, wherein each pulse in said serial keyboard data signal corresponds to a selected musical note in a selected octave;

a memory connected to the first and second counters for receiving a digital scan address signal wherein the least significant bits are received from the first counter and correspond to the notes corresponding to the columns in the keyswitch matrix, and the most significant bits are received from the second counter and corresponds to said octaves corresponding to the rows in the keyswitch matrix; and a control logic circuit including a logic gate that is enabled by a said pulse in said serial keyboard data signal for enabling the memory to store said scan address signal;

wherein the memory is connected to the note generator for providing said stored scan address signal to the note generator as said note address signal;

wherein the control logic circuit further includes a busy signal generator coupled to the memory and responsive to said pulse in said serial keyboard data signal that enabled the memory to store said scan address signal, for generating a busy signal for so long as the key that was manipulated to provide said pulse continues to be manipulated; and wherein the logic gate is inhibited by said busy signal from enabling the memory to store said scan address signal in response to a subsequent pulse in said serial keyboard data signal.

2. An electronic musical instrument according to claim 1, wherein the control logic circuit further includes a comparator for comparing the stored contents of the memory with the scan address signal; and the busy signal generator comprises a D flip-flop having its D input connected to receive said serial keyboard data signal and its clock input connected to the output of the comparator, wherein a busy signal is provided from an output of the D flip-flop in response to said pulse that enabled the memory to store said scan address signal, being provided when the comparator output signal for clocking the D flip-flop indicates that the scan address signal equals the stored contents of the memory, and said busy signal is removed from said output of the D flip-flop in response to said enabling pulse not being provided when the comparator output signal next indicates that the scan address signal equals the stored contents of the memory.

3. An electronic musical instrument, comprising a keyboard having a plurality of keys for selecting predetermined musical notes in predetermined octaves;

an encoder coupled to the keyboard for providing digital note address signals in response to manipulation of the keys on the keyboard;

a plurality of note generators that are responsive to said digital note address signals for respectively providing a plurality of output frequency signals corresponding to said selected musical notes in said selected octaves;

wherein the encoder includes a clock circuit for providing a pulsed scan clock signal;

a keyswitch matrix connected to the keyboard, wherein the matrix includes columns and rows of conductors and a plurality of keyswitches, and wherein each of the keyswitches is arrayed in the matrix for connecting the conductor of a given row to the conductor of a given column in response to said manipulation of a given key in the keyboard;

a counter circuit connected to the clock circuit for counting the pulses in said scan clock signal;

a decoder connected to the rows of the keyswitch matrix and to the counter circuit for sequentially providing signal pulses on the rows of the keyswitch matrix;

a multiplexer connected to the columns of the keyswitch matrix and to the first counter for scanning the columns of the keyswitch matrix at the rate of said scan clock signal to thereby provide a serial keyboard data signal including pulses provided from the keyswitch matrix in response to manipulation of the keys, wherein each pulse in said serial keyboard data signal corresponds to a selected musical note in a selected octave;

a plurality of memories equal in number to the plurality of note generators, with the memories being connected to the counter circuit for receiving a digit scan address signal for indicating individual keys on the keyboard; and being connected to the note generators for providing stored digital scan address signals to the note generators as said note address signals; and a control logic circuit that is responsive to said serial keyboard data signal for enabling said digital scan address signals to be stored into individual memories in accordance with the availability of the note generators, the control logic circuit comprising a plurality of first logic gates respectively connected to the memories, wherein each first logic gate is enabled by a said pulse in said keyboard data signal for enabling the connected memory to store said scan address signal;

a plurality of busy signal generators respectively coupled to the memories wherein each busy signal generator is responsive to said pulse in said serial keyboard data signal that enabled the coupled memory to store said scan address signal, for generating a busy signal for so long as the key that was manipulated to provide said pulse continues to be manipulated, and wherein the first logic gate connected to the coupled memory is responsive to said busy signal for inhibiting the coupled memory from storing said scan address signal in response to a subsequent pulse in said serial keyboard data signal;

a plurality of comparators respectively connected to the memories, wherein each comparator is for comparing said stored contents of the connected memory with the scan address signal and for providing a note taken signal when the scan address signal equals the stored contents of the connected memory;

a second logic gate connected to the comparators for providing a signal to the first logic gate for inhibiting the first logic gate from enabling said storage of said scan address signal in the respective connected memories whenever a said note taken signal is provided from any one of the comparators;

a shift register having a plurality of stages, with the outputs of the stages being respectively connected to the first logic gates for sequentially providing an enabling signal from only one of the output stages to the connected first logic gate to enable said scan address signal to be stored in only one connected memory to response to a single pulse in said serial data keyboard signal; and a third logic gate responsive to a said busy signal generated from the busy signal generator that is connected to the memory that was enabled for storing said scan address signal in response to said enabling signal from said one output stage that provided said enabling signal, for shifting the shift register to provide said enabling signal from a different output stage.

* * * * *